United States Patent [19]

Guerster et al.

[11] 4,010,913

[45] Mar. 8, 1977

[54] RETRIEVER REEL

[75] Inventors: Rene L. Guerster, Maple Glen; Leigh David Leiter, Willow Grove, both of Pa.

[73] Assignee: Ametek, Inc., New York, N.Y.

[22] Filed: Oct. 9, 1973

[21] Appl. No.: 404,433

Related U.S. Application Data

[63] Continuation of Ser. No. 185,506, Oct. 1, 1971, abandoned.

[52] U.S. Cl. ..... 242/107

[51] Int. Cl.[2] ..... B65H 75/48

[58] Field of Search ..... 242/107 R, 107.1, 86, 242/86.1, 54 R

[56] References Cited

UNITED STATES PATENTS

| | | | |
|---|---|---|---|
| 3,061,234 | 10/1962 | Morey | 242/107.1 |
| 3,144,218 | 8/1964 | Tepe | 242/107.1 |
| 3,222,002 | 12/1965 | Holberg | 242/54 R |
| 3,409,246 | 11/1968 | DePas | 242/107 R |
| 3,539,123 | 11/1970 | Shutt | 242/54 R |

*Primary Examiner*—Stanley N. Gilreath
*Attorney, Agent, or Firm*—Smith, Harding, Earley & Follmer

[57] ABSTRACT

A retriever reel for electrical or fluid lines in which a continuous connection is made between stationary and moving ends of the line by means of a random-lay spiral of line housed in the core of a rotatable drum and adapted to close in toward the central axis as the movable end of the line is uncoiled.

8 Claims, 5 Drawing Figures

INVENTORS
RENE L. GUERSTER &
LEIGH DAVID LEITER
BY
Smith, Harding, Earley & Follmer
ATTORNEYS

RETRIEVER REEL

This is a continuation of application Ser. No. 185,506, filed Oct. 1, 1971, now abandoned.

BACKGROUND OF THE INVENTION

This invention relates generally to retriever reels for use with electrical lines, fluid lines or the like.

There have been provided retriever reels of the indicated type providing a continuous electrical or fluid connection between the stationary and moving ends of a line. The reels of the prior art have not been entirely satisfactory since they involve rather complex mechanisms or require the use of slip rings or rotary joints which are quite expensive.

SUMMARY OF THE INVENTION

It is the general object of this invention to provide a retriever reel which includes a line providing a continuous connection between stationary and moving ends thereof, which reel is simple in construction and does not involve the use of slip rings or rotary joints.

Briefly stated, the retriever reel in accordance with the invention comprises a stationary base means, a drum means which is mounted for rotational movement relative to the base means and a continuous line means. The continuous line means has a first portion arranged for unreeling movement and being attached to the drum means, a second portion arranged for stationary mounting and being attached to the base means and an intermediate portion extending between the first and second portions and arranged in a spiral extending around the axis of the drum means. The spiral is adapted to permit relative movement between the drum means and the base means.

DETAILED DESCRIPTION OF THE PREFERRED EMBODIMENTS

While the invention will be described as applied to electrical or fluid lines, the invention is applicable to fiber optics lines, vacuum lines and lines for both pneumatic or hydraulic fluids. Moreover, both electrical and fluid lines may be enclosed in a conduit forming the line.

Figure 1:
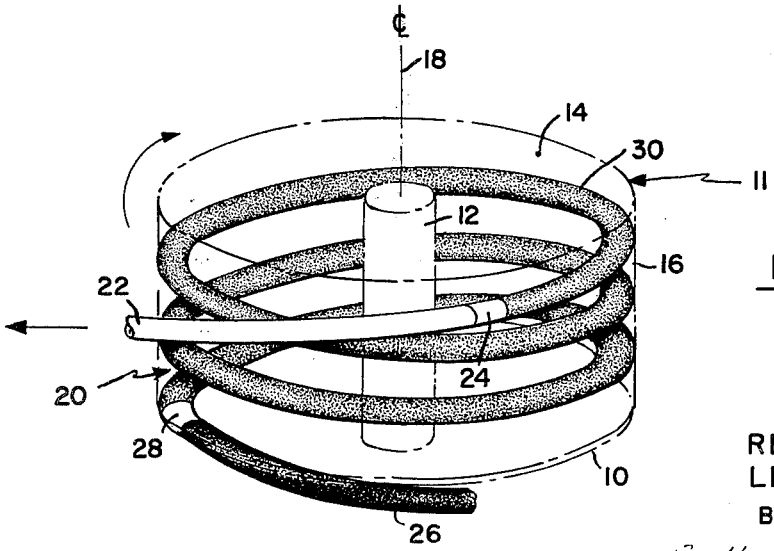
FIG. 1 is a schematic view which illustrates the principles of the invention.

As shown in the schematic illustration of FIG. 1, there is provided a stationary base means 10 and a rotatable drum means indicated generally at 11 and shown in dashed lines for illustrative purposes. The drum means 11 comprises a center shaft 12, an end wall 14 and a side wall 16. The drum means 11 is rotatable relative to the base means 10 on its central axis indicated at 18. A continuous line is designated generally at 20 and comprises a movable portion 22 which is attached at means 24 to the side wall 16 of the rotatable drum means 11. Line portion 22 is normally wound on the exterior of side wall 16, but is shown extending tangentially thereto in FIG. 1 for the sake of clarity of illustration. Line 20 has a stationary portion indicated at 26, which is attached at means 28 to the stationary base means 10. Housed in the core of the drum means 11 is a ramdon-lay spiral of line 30 which extends in a coiled arrangement between the movable and stationary line portions 22 and 26, respectively. The arrangement of the spiral 30 is such that it accommodates the rotating movement of the drum means 11 from the position shown in FIG. 1 by the closing of the spiral inwardly toward the center shaft 12. In other words, the spiral absorbs the rotation of the drum means 11 by the reduction of its coil diameter, and, of course, an increase in the number of coil turns. This will occur when the drum means 11 and line 22 move in the direction shown by the arrows, which involves the unreeling of line 22 from the drum side wall 16.

In the use of the retriever reel shown in FIG. 1, the reel would normally be in the position shown in this figure with the movable line portion 22 being coiled around the side wall 16 for a plurality of turns. The stationary line portion 26 would be connected to a suitable electrical and/or fluid connection at a stationary position, the line 20 providing a continuous electrical or fluid conduction from portion 26 through portion 30 to the free end of the unreeling portion 22. When it is desired to unreel the portion 22, the free end thereof is simply pulled in a direction shown by the arrow in FIG. 1 to thereby cause rotation of drum means 11 relative to base means 10 in the direction shown by the arrow in FIG. 1 to accommodate the unreeling movement of line portion 22. During this rotation of the drum means 11, the connection at 24 rotates around the central axis 18 with the drum means 11. As was discussed above, this rotation of the drum means is accommodated by the spiral 30 which will reduce in coil diameter and close inwardly towards the center shaft 12. This coiling of spiral portion 30 occurs since its one end is held stationary at means 28 on the base means 10, while its other end at means 24 is held on drum means 11 and rotates around axis 18 in a direction tending to increase the number of coils and reduce the coil diameter.

The parts will be designed to accommodate the amount of unreeling movement desired. When it is desired to rewind the reel, the drum means 11 is simply rotated in the opposite direction whereby the line portion 22 will be wound up on the exterior of side wall 16 and the spiral portion 30 will return to the coiled position shown in FIG. 1.

Figure 2:
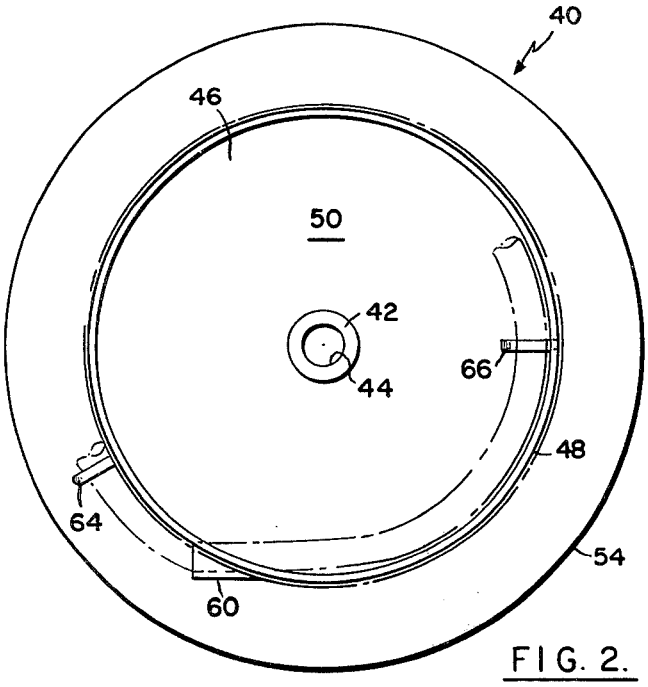
FIG. 2 is a plan view of a drum for use in retriever reel means in accordance with the invention.
Figure 4:
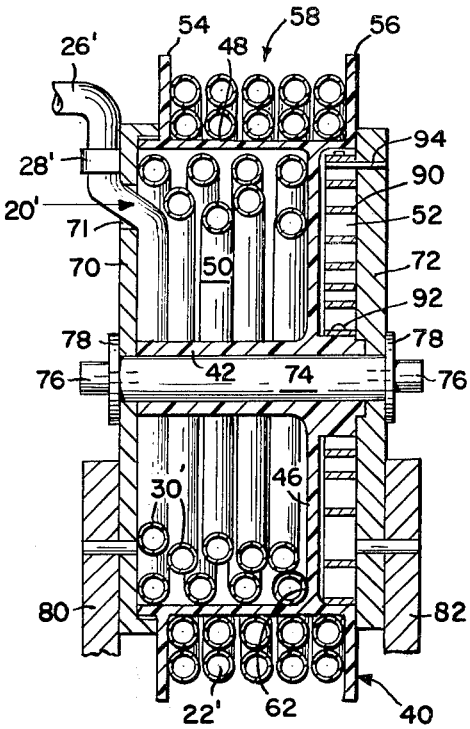
FIG. 4 is a sectional view of a retriever reel in accordance with the invention employing the drum shown in FIGS. 2 and 3.
Figure 3:
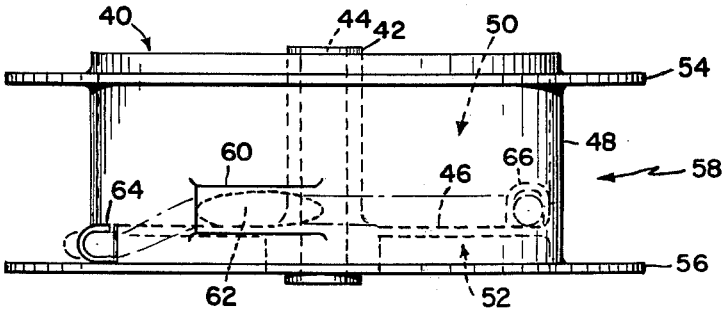
FIG. 3 is an end view of FIG. 2.

In FIGS. 2 and 3, there is shown a drum, indicated generally at 40, adapted for use in a retriever reel in accordance with the invention as shown in FIG. 4. The drum 40 is preferably made of plastic, has a generally hollow cylindrical configuration and comprises a central hollow shaft portion 42 having an axially extending central bore 44, a generally circular radially extending portion 46 which extends between shaft portion 42 and a tubular side wall portion 48 arranged concentrically with respect to shaft portion 42. An annular internal core or chamber 50 is defined between shaft portion 42 and side wall portion 48 on one side of radially extending portion 46. A second core 52 is defined on the other side of radially extending portion 46 between portions 42 and 48. A pair of spaced annular rims 54 and 56 extend outwardly from side wall portion 48 and define a coil-containing compartment 58.

The side wall portion 48 is provided with a passage defining means 60 which provides a smooth passage for the line extending between internal core 50 and external compartment 58. The passage defining means 60 defines a bore 62 adapted to contain a line portion which extends between core 50 and compartment 58 as shown in dashed lines in FIGS. 2 and 3. A clamp means 64 is mounted on the exterior of side wall portion 48 and is adapted to secure the line adjacent the external portion of the passage means 60. A clamp means 66 is mounted on the internal wall of side wall portion 48 and is adapted to secure the line within core 50 as it passes to the passage means 60, as is shown in FIG. 2. The clamp 66 is located so as to guide the line along the periphery of wall portions 46 and 48 into the bore 62, the line being held in a generally circular arc. The clamp 64 is positioned adjacent annular rim 56 so as to position the external end of the line adjacent one end wall of the compartment 58.

Referring to FIG. 4, there is provided an end cover 70 which encloses the open end of internal core 50 and an end cover 72 which encloses the open end of internal core 52. The drum 40 and the end covers 70 and 72 are all mounted on a metal pin 74, all these elements being held together by a pair of mounting screws 76 and associated washers 78, as is shown in FIG. 4. End covers 70 and 72 are mounted on stationary bracket arms 80 and 82 which support the entire reel assembly at a desired location. It will be apparent that while the end covers 70 and 72 are held in a stationary position, the drum 40 is adapted to rotate relatively thereto about the pin 74. The interface between the plastic drum 40 and the metal pin 74 is used as the rotary bearing pair.

In describing the manner in which the continuous electrical or fluid line is mounted on the retriever reel shown in FIG. 4, reference numerals corresponding to those used in FIG. 1 with primes added will be used on designate the continuous line. Thus, there is provided a continuous line 20' having a stationary portion 26' which has an end portion attached to end cover 70 by a clamp means 28' from which it extends through an opening 71 in cover 70 into the core 50.

The line 20' comprises a movable portion 22' which is coiled around side wall 48 in the external compartment 58 and which has its unreeling end attached to the drum 40 by the clamps 64 and 66 as was described above, this end portion extending through the passage means 60 from compartment 58 into internal core 50. It will be noted that the clamps 64 and 66 correspond to the attaching means 24 of the FIG. 1 showing. Housed in the core 50 of the drum 40 the line means 20' comprises an intermediate portion 30' in the form of a random-lay of spiral which extends in a coiled arrangement between the line portions 26' and 22' extending into core 50 through openings 71 and 62, as was described above. The arrangement of the spiral of portion 30' is such that it accommodates the rotating movement of the drum 40 as was described with respect to the showing in FIG. 1.

In some cases, the spiral line portion 30' may be provided with surface lubrication to increase its life and improve its operation.

Spring means are provided for biasing the drum 40 to a position in which the movable portion 22' of the coil is wound up on the drum 40, such as is shown in FIG. 4. Such means comprises a spiral spring 90, one end of which is secured at 92 to the shaft portion 42 and the other end of which is secured to a pin 94 extending from cover 72 into core 52 at a peripheral location thereof.

Figure 5:
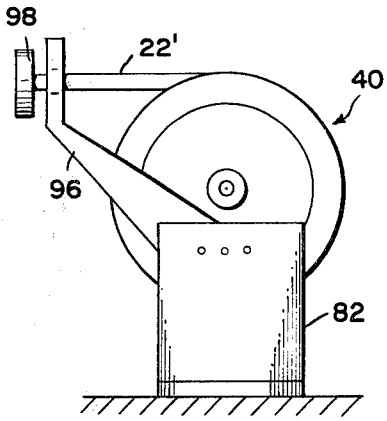
FIG. 5 is a side view of the retriever reel shown in FIG. 4.

Means are provided for limiting the winding up of coil portion 22' on the drum 40. To this end, a bracket 96 mounted on bracket arm 82 is provided with an opening through which coil portion 22' extends, the end of coil portion 22' being provided with a fitting 98 as is shown in FIG. 5. It will be apparent that the fitting 98 cooperates with the bracket 98 to limit the wind up movement of the coil portion 22' in response to the bias of spiral spring 90.

It will be apparent that the retriever reel shown in FIG. 4 will operate in the same manner as the embodiment shown in FIG. 1. Thus, the stationary line portion 26' is connected to a suitable electrical or fluid connection at a stationary location adjacent the retriever reel. The line 20', of course, provides a continuous electrical or fluid conduction from stationary portion 26' to the free end of movable portion 22'. When it is desired to move the free end of portion 22' to a location distant from the reel, this free end is simply pulled from the drum 40 causing the same to rotate relative to the stationary end covers 70 and 72. It will be noted that cover 70 corresponds to the base means 10 of the FIG. 1 embodiment. As the line 22' is unreeled and the drum 40 is caused to rotate, the portion of the line extending through passage 62 and secured to the drum 40 rotates about the axis of the pin 74 and moves relative to the fixed portion 26' of the line extending through opening 71. This movement is accommodated by the spiral portion 30' and is in a direction which will cause the coil diameter of the spiral to close inwardly towards the shaft portion 42. This movement of the drum 40 is against the bias of the spring 90 which is wound up in response to the drum rotation. When the free end of the line portion 22' is released, the spring 90 then operates to urge the drum 40 to rotate in the opposite direction to rewind the line portion 22' onto the drum. The spiral portion 30' accommodates this movement by moving from a tightly coiled condition to a more loosely coiled and larger coil diameter condition.

It will be apparent that various changes may be made in the construction and arrangement of parts without departing from the scope of the invention. Wherefore it is not desired to be limited except as required by the following claims.

We claim:

1. A retriever reel comprising a stationary base means, a drum means mounted for rotational movement relative to said base means, a continuous line means having a first portion arranged for unreeling movement from said drum means, a second portion arranged for stationary mounting on the base means and an intermediate portion extending between said first and second portions and arranged in a random-lay spiral coil having a variable diameter and multiple layers extending around the axis of said drum means and remote therefrom to accommodate said relative movement, means attaching said first line portion to said drum means, and means for attaching said second line portion to said base means, said random-lay spiral coil decreasing in coil diameter as the drum means rotates in one direction relative to the base means as the first portion of the line means is unreeled and increasing in coil diameter when the drum means rotates in the other direction relative to the base means to rewind the first portion of the line means onto the drum means.

2. A retriever reel according to claim 1 in which said drum means includes an internal annular chamber and a peripheral wall portion encircling said chamber, said intermediate line portion being arranged in said spiral within said chamber.

3. A retriever reel according to claim 2 wherein said first line portion is wound on the exterior of said wall portion and including a passage formed in said wall portion to extend between the exterior thereof and said internal chamber, said line means extending through said passage to join said first and intermediate line portions.

4. A retriever reel according to claim 3 wherein said base means includes a member stationarily mounted adjacent said chamber and having a passage therein providing a connection between the exterior of the reel and said chamber, said line means extending through said last-named passage to join said second and intermediate line portions, said last-named passage being located at the outer portion of said chamber adjacent said wall portion encircling the same.

5. A retriever reel according to claim 4 including spring means biasing said drum means toward rotation in a direction to coil said first line portion on said drum.

6. A retriever reel according to claim 1 including spring means biasing said drum means toward rotation in a direction to coil said first line portion on said drum means.

7. A retriever reel according to claim 4 wherein said means for attaching said first line portion to said drum means includes a first clamp means within said chamber for securing said line to said drum at a location within said chamber and a second clamp means on the exterior of said wall means for securing said line means thereto at an external location.

8. A retriever reel according to claim 7 wherein said first clamp means is arranged to hold said line against the interior of said wall means and said second clamp means is arranged to hold said line against the exterior of said wall means, said first and second clamp means being spaced circumferentially from said first-named passage to hold said line means in a smooth, curved configuration of bending in the circumferential direction as it passes from the interior of said chamber to the exterior of said wall means.

* * * * *